United States Patent [19]

Muller, Jr.

[11] Patent Number: 4,844,520

[45] Date of Patent: Jul. 4, 1989

[54] LATCH MECHANISM

[75] Inventor: Leonard Muller, Jr., Bellevue, Wash.

[73] Assignee: Heath Tecna Aerospace Co., Kent, Wash.

[21] Appl. No.: 123,153

[22] Filed: Nov. 20, 1987

[51] Int. Cl.[4] ..... E05C 1/10

[52] U.S. Cl. ..... 292/128; 292/341.17

[58] Field of Search ..... 292/121, 128, 163, 193, 292/302, 341.18, 341.19, DIG. 71, 101, 93, 113, DIG. 40, DIG. 37, DIG. 64, DIG. 53, 336.3, 347

[56] References Cited

U.S. PATENT DOCUMENTS 2,435,987 2/1948 Tierney et al. ..... 292/DIG. 40 X 2,681,819 6/1954 Burke ..... 292/341.19 X 3,346,288 10/1967 Cosentino ..... 292/341.17 X 3,572,065 3/1971 Peters ..... 292/302 X 3,918,755 11/1975 Murphy et al. ..... 292/78 X

*Primary Examiner*—Richard E. Moore

*Attorney, Agent, or Firm*—Christensen, O'Connor, Johnson & Kindness

[57] ABSTRACT

A releasable latch assembly for securely fastening the doors of overhead airline storage bins. The latch securely fastens the door and prevents the release of the door absent the application of an intentional manual force to the latch assembly. The latch assembly provides a means that compensates for movement of the fastened surfaces or for misalignment of the surfaces due to installation tolerances.

14 Claims, 4 Drawing Sheets

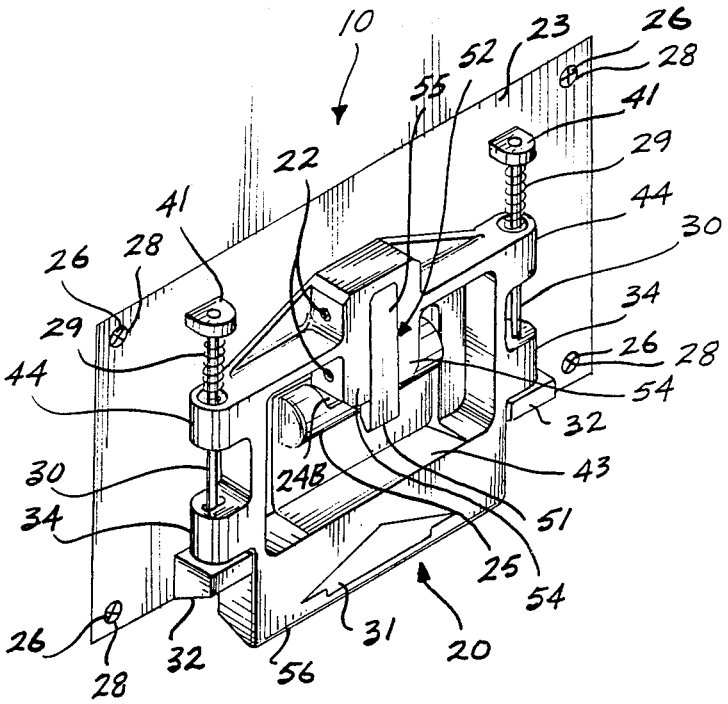
Fig. 1.
Fig. 3.
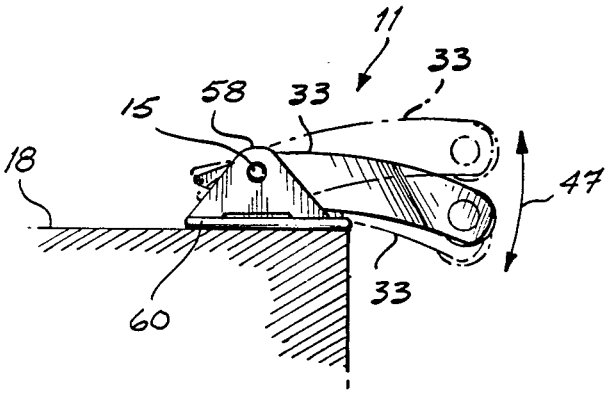

LATCH MECHANISM

BACKGROUND OF THE INVENTION

The present invention relates to releasable latch mechanisms, particularly those releasable latch mechanisms employed on doors of airline overhead storage bins.

With increased concern for passenger safety on commercial airplanes, the airline industry is constantly looking for ways to decrease the potential for any type of accidental injury. With the number of travelers who now insist on carrying as much luggage as possible onto the plane, the utilization of overhead storage bins and other storage bins has become increasingly popular. As more items of increasing weight are placed into these bins, it is important that the doors of such bins be well secured.

The potential for injury as a result of an accidental opening of a storage bin door is great. Vibrations and jolts resulting from take-off and landing, as well as in flight turbulences are often violent enough to jar open storage bin doors fastened by conventional means, or to cause the bin contents to contact the latch mechanism in such a manner that causes the latch mechanism to release. Also, deformation of the storage bin floor due to the weight of the luggage placed into the storage bin may cause the bin door to become difficult to shut or to shut less than securely. Similarly, incorrect alignment or adjustment of the latch or surfaces to be fastened may hinder the closing and/or securing of the bin door.

In the special application of airline storage bin doors, it is necessary that the latch mechanism used by simple and easy to operate, as well as easy to maintain and adjust. The amount of effort required to open and close such latch mechanism must be kept at a minimum to allow passengers to easily open and close the storage bins themselves. Also, the latch must be easily releasable when desired by a passenger in order that easy access may be had to ones carry-on luggage. The latch should also be reliable and not susceptible to coming out of alignment. The reliability of the latch should be consistently good over a wide range of operating conditions. Finally, the latch should not be so bulky that it occupies a substantial portion of the useful interior of the storage bin.

In airline storage bin doors, many latch mechanisms that are used in other applications would most likely ensure the secure closing of the overhead bin doors. However, such latches are not easily releasable and accordingly would not be compatible with the airlines need to allow passengers to easily open and close the doors at almost any time during the flight.

Therefore, the need exists, particularly in the airline industry for a latch mechanism for the doors of overhead storage bins that is easily closable, securely fastens the door, is not susceptible to release due to vibrations or jolts, yet is easily openable by the passenger when he or she is prepared to load or unload his or her luggage. Such latch may be equally applicable to other applications where releasable, secure, reliable fastening is desired.

SUMMARY OF THE INVENTION

The present invention relates to a releasable latch mechanism for securely fastening a first surface to a second surface. The releasable latch mechanism includes a striker arm having a striker end. The striker arm is rotatably mounted to a striker support. The striker support includes a rotatable support for the striker arm and fasteners for mounting the striker support onto the first surface to be fastened. The striker arm has means for restricting the rotatability of the striker arm in the striker support. The releasable latch mechanism also includes a hook means mounted in a hook housing. The hook housing is slidably mounted to a base plate that includes supports for slidably mounting the hook housing and an opening in its face for allowing the hook means to project through the face of the base plate. The face of the base plate also includes a means for receiving and retaining the striker means so that the hook means and base plate cooperate to securely fasten the striker means. The base plate also includes holes for mounting the base plate to the second surface to be fastened.

In a preferred embodiment, the first surface to be fastened is the inside of an overhead airline storage bin and the second surface to be fastened is the door of an overhead airline storage bin. In the preferred embodiment, the striker support is mounted onto the inside surface of the overhead airline storage bin and the base plate is mounted to the door of the overhead airline storage bin. A particularly useful embodiment of the present invention relates to a releasable latch mechanism that may be retrofitted for use in existing airline overhead storage bins.

The releasable latch mechanism of the present invention provides a simple, yet very secure mechanism for fastening various structures together, particularly overhead airline storage bins and their doors. The latch assembly is particularly easy to engage; however, it will not disengage until an intentional manual force is exerted upon the latch mechanism. The latch mechanism exhibits a degree of flexibility that allows for structural deflections as well as installation tolerances while maintaining a fastened position. This provides a safe method for securing the doors of overhead airline storage bins and preventing the injuries that may occur from luggage which has fallen out of the overhead storage bins that have accidentally opened.

BRIEF DESCRIPTION OF THE DRAWINGS

The present invention will become more apparent from the following description herein when considered together with the accompanying drawings. Such drawings are set forth as being merely illustrative of the invention and are not intended in any way to be limitative thereof. It is to be understood that modifications and changes in the preferred embodiments of the invention herein described and shown may be made without departing from the spirit and scope of the present invention.

FIG. 1 is an isometric view of the rear of the base plate of the releasable latch mechanism in accordance with the present invention in an engaged position.

FIG. 3 is a side elevational view of the striker arm and the striker support in accordance with the present invention.

DETAILED DESCRIPTION OF THE INVENTION

Figure 4:
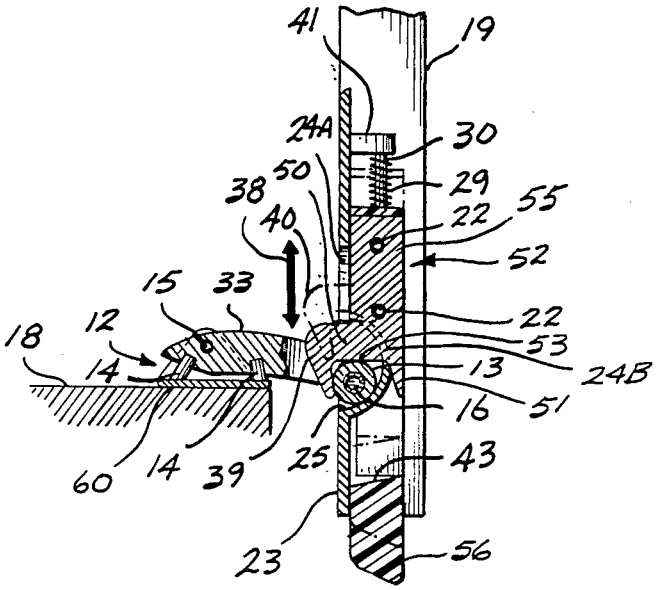
FIG. 4 is a cross-sectional, side view of the base plate of the releasable latch mechanism in accordance with the present invention in both an engaged and disengaged position. The disengaged position is illustrated by the dotted lines.
Figure 6:
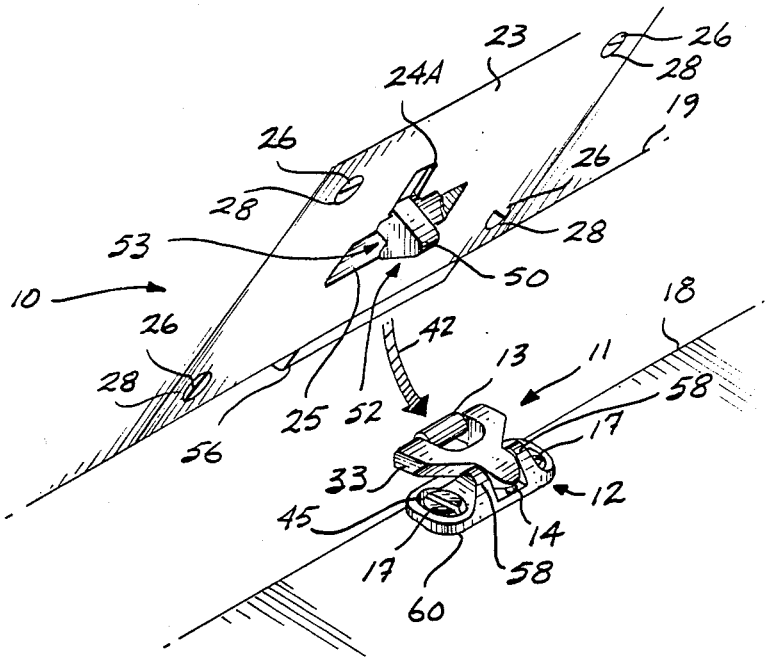
FIG. 6 is an isometric, environmental view of the latch assembly in accordance with the present invention in a disengaged position.

Referring to FIGS. 1, 4 and 6, the base plate 23 is a rectangular, flat member. In each of the four corners of the plate 23 are located holes 28 that are used to secure the base plate 23 to a second surface 19 to be fastened to a first surface 18. Protruding from the rear of the base plate 23 is the rear wall of a recess 25 in the front of the base plate 23. The recess 25 is a half cylinder indented into the front of the base plate 23. The recess 25 is positioned horizontally in the center of the base plate 23 and is off set vertically in a direction towards the bottom of the base plate 23. The recess 25 is positioned so that the length of the recess is parallel with the top and bottom edges of the base plate 23. An opening 24B passing through the top half, central portion of the rear wall of recess 25 allows the front and back of the base plate 23 to communicate. A vertical, centered slot (24A in FIG. 6) communicates with the top of the opening 24B in the recess 25. The vertical slot 24A communicates between the front and back of the base plate 23.

Referring primarily to FIGS. 1 and 4, the rear of the base plate 23 has first and second vertically oriented pins 30 mounted to the back of the base plate 23. The pins 30 are positioned respectively near the left and right hand edges of the base plate 23 intermediate the holes 28 located on the sides of the base plate 23 for securing the base plate 23 to a surface to be fastened and the rear wall of the recess 25. The pins 30 extend vertically a height substantially equivalent to the height of the base plate 23. The base of each pin 30 is supported by a lower hook housing stop 32 positioned near the bottom of the base plate 23. The lower hook housing stops 32 extend rearwardly in a direction orthogonal from the rear of the base plate 23 and provide vertical holes for securely fastening the bottom of the vertical pins 30 within the lower hook housing stops 32. The top of each vertical pin 30 is securely fastened to the rear of the base plate 23 by a first and second pin support 41 that are vertically aligned with the lower hook housing stops 32. Each pin support 41 includes a flange that protrudes from the rear of the base plate 23 in a direction orthogonal to the rear of the base plate 23. Each flange includes a vertical bore passing through it for receiving the top portion of the pins 30.

The vertical pins 30 are sliding mounts for a hook housing 20. The hook housing 20 is an essentially rectangular, flat member with a front and back face, that is positioned with one face against the rear of the base plate 23 for sliding motion in a direction parallel to the rear surface of the base plate 23 as discussed hereinafter. A rectangular bore passes through the central, top portion of each face of the hook housing 20, thus allowing the protruding rear wall of the recess 25 in the rear of the base plate 23 to pass through the hook housing 20. This allows the hook housing 20 to fit closely against the rear surface of the base plate 23. The bore has dimensions that allow the protruding recess 25 to pass through the hook housing 20, thus allowing the hook housing 20 to be capable of freely sliding vertically in relation to the protruding recess 25.

Centrally located in the top edge of the flat hook housing 20 are a pair of vertical hook flanges 54. The vertical hook flanges 54 are spaced apart horizontally a distance substantially equivalent to the width of a hook 52 that resides between the hook flanges 54. The hook flanges 54 are of a length substantially equivalent to the height of the hook 52, thus allowing for the secure fastening of the hook 52 between the hook flanges 54. The hook 52 is securely fastened between the hook flanges 54 by a pair of pins 22 passing horizontally through each hook flange 54 and the hook 52. The hook flanges 54 extend vertically above the top edge of the hook housing 20 and below the top edge of the hook housing 20 into the bore through the hook housing 20. The hook flanges 54 are constructed so that when the hook housing 20 is in its lowermost position on the rear of the base plate 23, the bottom of the hook flanges 54 will be positioned in the opening 24B in the recess 25. The positioning of the hook housing 20 will be described in greater detail hereinbelow. The width of the bottom portion of the hook flanges 54 and the hook 52 is such that the hook flanges 54 and the hook 52 may slidably pass through the opening 24B in the rear upper wall of the recess 25 in the base plate 23.

The hook 52 includes an upper body 55 that has dimensions that allow the upper body 55 to slidably pass into the space between the vertical hook flanges 54 of the hook housing 20. The upper body of the hook 52 has a thickness from front to back that is essentially equivalent to the thickness of the hook housing 20 from its front face to its back face, thus allowing the upper body 55 and hook 52 to be flush mounted within the hook flanges 54 of the hook housing 20. Located on the lower portion of the hook 52 opposite the upper body 55 is a jaw 53 member with a first 50 and a second 51 arm extending downward. The second arm 51 is a direct downward extension of the rear of the upper body 55 of the hook 52, however, it is narrower from front to back than the upper body 55 of the hook 52. The rear of the second arm 51 is flush with the rear of the upper body 55. The second arm 51 extends downwardly to the rear of the recess 25 protruding from the back of the base plate 23. When the hook housing 20 is in its lowermost position, the lower edge of the second arm 51 is adjacent the bottom of the recess 25. The first arm 50 extends orthogonally forward from the bottom of the upper body 55, thus causing the first arm 50 of the jaw 53 to protrude horizontally through the front of the base plate 23 through the openings 24A and 24B.

The first arm 50 includes a hook-shaped member on the forwardmost end of the first arm 50. The hook-shaped member curves downward so that the first arm 50 has a horizontal shaft and a vertical finger. Thus, the hook 52 on its lower end includes a jaw 53 having a first arm 50 and a second arm 51. When the hook housing 20 is in its lowermost position, the inside surfaces of the arms 50 and 51 defines a space that is occupied by the bottom half of the cylindrical recess 25. The finger of the first arm 50 extends downwardly so that the lowermost edge of the vertical finger is essentially adjacent to the lower front edge of the recess 25 in the front of the base plate 23. The interior of the vertical finger of the first arm 51 and the rear bottom portion of the recess 25 form a cavity that will securely fasten a striker 13 that is attached to the first surface to be fastened as will be discussed in more detail hereinafter.

Referring to FIG. 1, located on the bottom of the hook housing 20 is a release shoulder 56 protruding downwardly from the lower edge of the bore passing through the hook housing 20. The release shoulder 56 has a width that is substantially equivalent to the distance between the lower hook housing stops 32 and has a height that allows it to extend beyond the lower edge of the base plate 23 when the hook housing 20 is in its lowermost position, thus providing a surface which may be manipulated by the user when the base plate 23 is fastened to the surface to be fastened. The top of the release shoulder 56 defines the lower edge 43 of the bore passing through the hook housing 20.

Limit stops 34 extend horizontally outward from the left and right hand lower sides of the rectangular hook housing 20 above the release shoulder 56. The limit stops 34 are flanges that have a bore passing through the center thereof, thus allowing the limit stops 34 to be mounted for sliding on the vertical pins 30. The limit stops 34 extend outwardly from the left and right hand edges of the hook housing 20 at a position that is closely related to the bottom edge of the bore passing through the center of the hook housing 20. Near the top of the hook housing 20 extending horizontally outward from the left and right hand edges of the hook housing 20 are sliding guides 44. The sliding guides 44 are protruding flanges that contain a bore that passes through the center thereof, thus allowing the sliding guides 44 to be mounted for sliding on the vertical pins 30.

Countersunk into the top portion of the sliding guides 44 is an additional hole that is of a diameter larger than the bore for the pins 30. The countersunk hole receives the lower portion of a spring 29 that is positioned on the vertical pins 30 intermediate the sliding guides 44 and the upper pin supports 41. The springs 29 supply a downward force to the sliding movement of the hook housing 20 on the vertical pins 30. The downward movement of the hook housing 20 is limited by the contact between the lower hook housing stops 32 on the rear of the base plate 23 and the limit stops 34 on the hook housing 20. The lowermost position of the hook housing 20 is defined by the contact of the lower hook housing 32 and the limit stops 34.

Referring back to FIGS. 1 and 4, the position of the limit stops 34 and the first arm 50 of the jaw 53 is such that the limit stops 34 and the lower hook housing stop 32 contact each other when the jaw 53 is in a position that substantially encompasses the recess 25 in the front of the base plate 23. The positional relationship between the pin supports 41 and the sliding guides 44 is such that the pin supports 41 and sliding guides 44 in cooperation with the spring 29 do not totally restrict the vertical movement of the hook housing 20, until a point where the jaw 53 and particularly the finger of the first arm 50 has been substantially removed from encompassing the recess 25 in the front of the base plate 23. Further, referring to FIG. 5, the horizontal shaft of the first arm 50 and the top of the vertical slot 24A in the front of the base plate 23 must not contact each other until the fingers of the first arm 50 have been substantially removed from encompassing the recess 25 in the front of the base plate 25.

Figure 2:
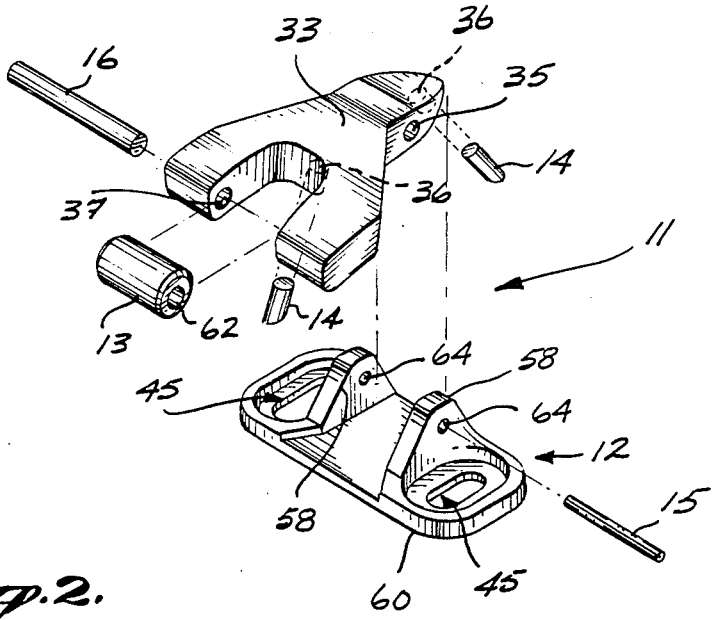
FIG. 2 is an exploded, isometric view of the component parts of the striker arm and striker support in accordance with the present invention.

Referring additionally to FIGS. 2 and 3, the striker 13 has dimensions that allow the striker 13 to fit securely between the interior surface of the vertical finger of the first arm 50 and the bottom portion of the cylindrical recess 25 in the front of the base plate 23. Cooperation between these elements securely fastens the striker 13 within the recess 25. In a preferred embodiment, the striker 13 is a cylindrical member having a width that is slightly wider than the width of the hook 52. The striker 13 has a horizontal bore 62 passing through the axial center thereof, thus allowing the passage of a securing pin 16 that allows the striker 13 to freely rotate.

The striker 13 (FIG. 2) is mounted by the securing pin 16 between the furcations of a forked end of a striker arm 33. In a preferred embodiment, the striker arm 33 is a relatively flat Y-shaped member that is mounted to a striker support 12 so that the forked end of the striker 13 extends generally in a first direction away from the first surface 18 to be secured to a second surface 19. The striker support 12 is then mounted to the first surface 18 that is to be fastened to the second surface 19 containing the base plate 23 and hook housing 20. A horizontal bore 37 passes through the left hand furcation and partially through the right hand furcation of the forked end of the striker arm 33 in a direction parallel to the leading edges of the furcations. The bore 37 through the furcations and the bore 62 through the striker 13 have dimensions that allow the securing pin 16 to pass through the furcations and the striker 13, thus rotatably mounting the striker 13 between the furcations of the striker arm 33. The striker 13 is mounted between the furcations, so that an opening exists between the rear edge of the striker 13 and the surface where the furcations join together. This passage has dimensions that allow the vertical finger of the first arm 51 to pass therethrough. Also, the front edge of the striker 13 is substantially flush with the front edges of the furcations.

Although the striker 13 is illustrated in the preferred embodiment as a cylindrical roller, other configurations will be equally operable. For instance, the striker 13 may be machined as part of the striker arm 33. Though preferred, it is not required that the striker 13 freely rotate. What is required is that the passage described hereinabove be provided between the striker 13 and the striker arm 33 so that the vertical finger of the first arm 50 may pass therethrough, thus securely fastening the striker 13.

The base of the Y-shaped striker arm 33 has a horizontal bore 35 passing therethrough in a direction parallel to the bore 62 passing through the furcations, thus allowing cooperation between a retaining pin 15 and the bore 35 for rotatably mounting the striker arm 33 to the striker support 12. The striker support 12 includes a mounting bracket 60 for attachment to a surface to be fastened. The mounting bracket 60 is a rectangular shaped member with rounded corners that has holes 45 in the left and right hand ends for passage of screws, or pins, that will secure the striker support 12 to the surface to be fastened. Located on the mounting bracket 60, intermediate the holes 45 are a first and second vertical support flanges 58 that extend vertically upward from the mounting bracket 60. The first and second support flanges 58 are spaced a distance sufficient to allow the base member of the Y-shaped striker arm 33 to fit between the support flanges 58. Each support flange 58 contains a bore 64 passing therethrough in a direction parallel to the bore 62 in the furcations. The bores 64 through the support flanges 58 and the bore 35 through the base of the striker arm 33 cooperate with a retaining pin 15 to rotatably mount the striker arm 33 to the striker support 12. The striker arm 33 is mounted so that the striker 13 can move between first and second positions in a direction transverse to the direction that the striker arm 33 generally extends from the first surface 18.

Referring primarily to FIG. 2, in a preferred embodiment the bottom of the striker arm 33 near the rearward most portion of the striker arm 33 base and near the point where the furcations of the forked end come together includes a first and a second rubber bumper 14. The rubber bumpers 14 are seated in cavities 36 within the body of the striker arm 33 and protrude downward from the bottom of the striker arm 33. The bumpers 14 serve to cushion and restrict the rotatable movement of the striker arm 33 within the striker support 12. Referring to FIG. 3, the bumpers 14 restrict the range of vertical movement 47 of the striker arm 33. The bumpers 14 may be any material that exhibits viscoelastic properties, preferably rubber and the like.

When the releasable latch mechanism 10 is engaged, it is possible that either the first surface 18 or the second surface 19 may be subjected to forces that may result in the deformation of either surface. With conventional latch mechanisms, it is possible that such deformation will result in the accidental disengagement of the latch from the fastening mechanism. Also, misalignment or misadjustment when the latch assembly is mounted can result in accidental disengagement or the inability to engage the latch.

Figure 5:
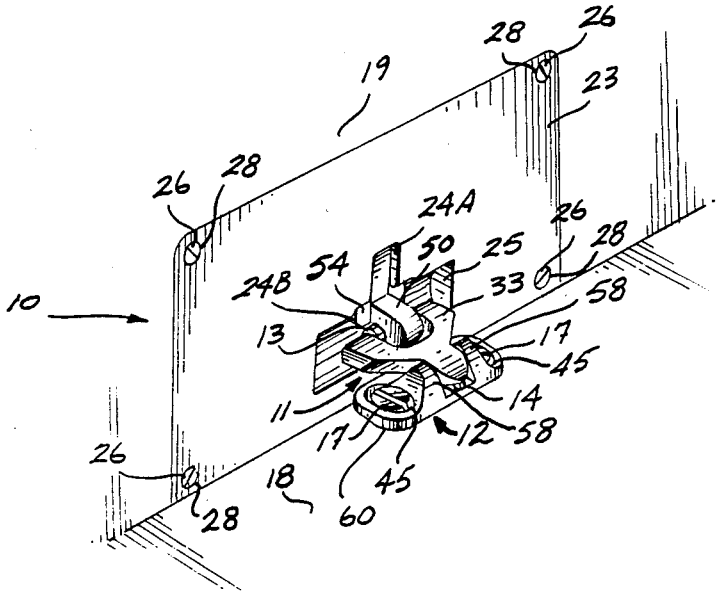
FIG. 5 is an isometric, environmental view of the latch assembly in accordance with the present invention in a latched position.

Referring to FIGS. 2 and 3, rubber bumpers 14 mounted in the bottom of the striker arm 33 allow the striker arm 33 to exhibit a limited range of vertical rotation 47, when the roller 13 is engaged by the first arm 50 and recess 25. The bumpers 14 damp any effects of deformation or misalignment of the first surface 18 or the second surface 19. The bumpers 14 are very useful because the first arm 50 and the recess 25 securely fasten the striker 13, thus a certain amount of flexibility must be incorporated into the latch mechanism 10 so that the base plate 23 or striker support 12 are not unintentionally, forcibly removed from the first surface 18 or the second surface 19. Without such flexibility, the securing screws 26 or 17 may be forcibly detached from the first surface 18 or second surface 19 by deformations or misalignment in the surfaces while the latch mechanism 10 is engaged. In FIG. 5 it is only possible to see one bumper 14, however, reference to FIG. 2 shows that there are two bumpers 14 located within the striker arm 33.

Figure 7:
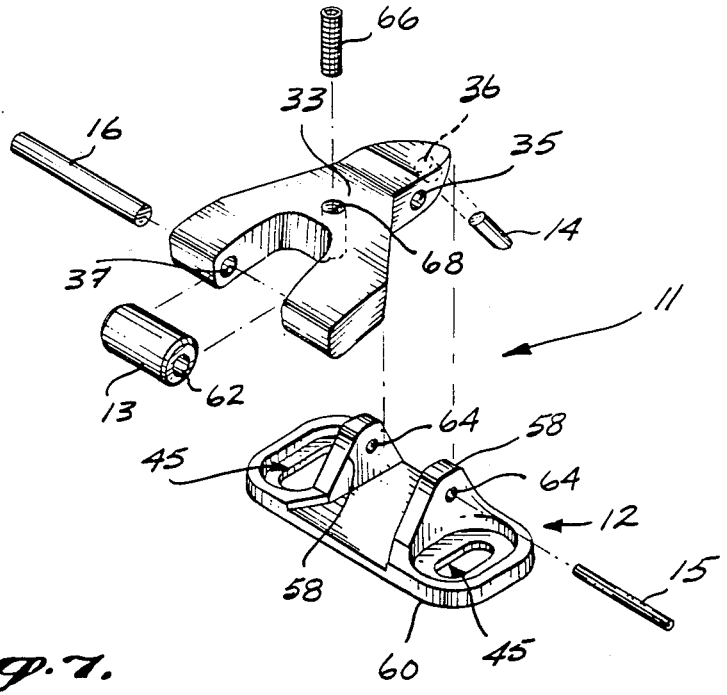
FIG. 7 is an exploded, isometric view of the component parts of the striker arm and striker support.

Referring to FIG. 7, in an alternative embodiment, the striker arm 33 has the bumper 14 nearest the striker 13 replaced by a threaded bore 68 for receiving a threaded screw 66. The bore 68 passes completely through the striker arm 33. The screw 66 is of a length that allows the screw 66 to pass through the bore 68 and contact the striker support 12 below the striker arm 33. The screw 66 is adjustable from above the striker arm 33. The cooperation between the screw 66, bore 68, striker arm 33 and striker support 12 allow for the fine tuning of the position of the striker arm 33 within the striker support 12 without totally sacrificing the rotatable movement of the striker arm 33 within the striker support 12. This allows for an adjustment to compensate for installation tolerances and other sources of misalignment. It is possible that other means may be used to adjust the position of the striker arm 33 within the striker support 12, such as shims, and the like.

Referring to FIG. 4, the leading edge of the first arm 50 is angled inwardly towards the face of the base plate 23. This angled surface allows the striker 13 and the first arm 50 to cooperate so that when the leading edge of the first arm 50 contacts the striker 13, the first arm 50 will be displaced vertically a distance sufficient to allow the striker 13 to enter the recess 25. Once the striker 13 has entered the recess 25 and passed the lowermost portion of the first arm 50, the first arm 50 will engage the striker 13 in the recess 25 by moving downwardly to its original position encompassing the recess 25. As the first arm 50 moves up and down, so does the hook housing 20 because the first arm 50, second arm 51 of the jaw 53 are a part of the hook 52 that is fastened to the hook flanges 54 of the hook housing 20 by the pins 22.

Referring to FIGS. 5 and 6, the releasable latch mechanism 10 is in a latched and unlatched position, respectively. The base plate 23 is securely mounted to a second surface 19 to be fastened, in this preferred embodiment the interior of the door of an airline overhead storage bin. The striker support 12 is securely mounted to the first surface 18 to be fastened, in this preferred embodiment, the inside floor of an airline overhead storage bin. The base plate 23 is securely fastened to the second surface 19 by the fastening means 26 positioned at each of the four corners of the base plate 23 passing through the openings 28. The fastening means 26 may be of the sort conventionally used in the airline industry such as screws, rivets, and the like. The rear of the base plate containing the hook housing 20 resides in the inside of the surface 19. The base plate 23 is preferably mounted flush with the surface 19. The lower edge of the base plate 23 is closely aligned with the lower edge of the surface 19 thus placing the release shoulder 56 below the lower edge of the surface 19.

The striker support 12 is securely fastened to the first surface 18 by a fastening means 17 passing through holes 45. Such fastening means 17 may be of the type conventionally used in the airline industry, such as screws, rivets, and the like. The striker support 12 supports the striker arm 33 that has the striker 13 rotatably mounted thereto, between the furcations of the forked end as discussed hereinbefore. The striker 13, striker arm 33, and striker support 12 make up the striker assembly 11 as discussed with reference to FIGS. 2 and 3. The striker support 12 is mounted to the inside of the first surface 18 in a position that will place the striker 13 directly adjacent to the recess 25 and the first arm 50 when the second surface 19 is brought in proximate position with the first surface 18.

As the first 18 and second 19 surfaces are brought closer together the first arm 50 contacts the striker 13 and is displaced vertically by the striker 13. The striker 13 will enter the recess 25 in the face of the base plate 23. When the striker becomes seated in the recess 25, the first arm 50 will return to its original position, thus securely fastening the striker 13 within the recess 25. The recess 25 limits the movement of the striker 13 relative to the hook 52 when the hook 52 is capturing the striker 13 and the end of the striker arm 33 remote from the striker 13 is moved in a direction transverse to the first direction that the striker arm 33 extends away from the first surface 18. The recess 25 also limits the movement of the striker 13 when the second surface 19 is moved in a direction transverse to the first direction that the striker arm 33 extends away from the first surface 18.

Referring primarily to FIG. 6, the releasable latch mechanism 10 is in a disengaged position. The second surface 19 is moved in a downward direction 42 in order to fasten it to the first surface 18. As the second surface 19 is brought into proximate position adjacent the first surface 18, the first arm 50 that passes through the face of the base plate 23 engages the striker 13 of the striker arm 33 as discussed above. The striker 13 and striker arm 33 are seated in the recess 25 in the face of the base plate 23. The cooperation between the first arm 50 and the recess 25 prevent the striker 13 and the striker arm 33 from being displaced from the recess 25 after the striker 13 and striker arm 33 have become engaged in the recess 25. As discussed above in reference to FIG. 1, the first arm 50 is mounted for sliding within the openings 24A and 24B to allow for the vertical displacement of the first arm 50 upon the entrance of the striker 13 into the recess 25. After the striker 13 and striker arm 33 have entered the recess 25 by vertically displacing the first arm 50, the first arm 50 engages the striker 13 by returning to its original position.

Referring to FIG. 4, the relative positions of the engaged and disengaged first arm 50 are represented by the solid lines 39 and the broken lines 40, respectively. The engagement of the striker 13 by the first arm 50 and recess 25 does not require an exertion of manual force upon the release shoulder 56 of the hook housing 20. Rather, the substantial rigidness of the striker arm 33, striker support 12, and striker 13 as they contact the slightly inwardly angled face of the slidably mounted first arm 50 causes the first arm 50 to be displaced vertically as indicated by arrow 38 enough to allow entry of the striker 13 and striker arm 33 into the recess 25.

Additionally referring to FIG. 5, the releasable latch mechanism 10 is in an engaged position represented by the solid lines. First surface 18 and second surface 19 are proximately positioned with relation to each other. The striker 13 and striker arm 33 are seated in the recess 25 in the face of the base plate 23. The first arm 50 engages the striker 13 within the recess 25 and, thus securely fastens the first surface 18 to the second surface 19.

The hook housing 20 including the first 50 and second arm 51 of the jaw 53, hook body 52, and release shoulder 56 may be vertically displaced to an upper position represented by broken lines 40 to allow for the disengagement of the striker 13 from the first arm 50 and the recess 25. An intentional manual force applied upwardly to the lower release shoulder 56 in the direction of the arrow 31 will result in the vertical movement of the hook housing 20 and its component parts to an upper position represented by the broken lines 40. The striker 13 and the striker arm 33 are then able to disengage the first arm 50 and the recess 25. Until such an intentional manual vertical force is exerted upon the release shoulder 56, displacing the hook housing 20 vertically, the striker 13 and striker arm 33 are unable to disengage the first arm 50 and recess 25. This action prevents the latch mechanism from accidentally releasing the surfaces to be fastened, an important feature particularly in light of the safety concerns in typical airline storage bin placements.

While the present invention will find application wherever two surfaces are desirably fastened together, in a preferred embodiment, the present invention provides a safe and convenient means for securely fastening the doors of airline storage bins. The releasable latch mechanism prevents the accidental opening of the storage bin door due to overloading, turbulence in the air or installation tolerances. The releasable latch mechanism also provides a mechanism whereby the door may be securely fastened without the need for any extreme amount of manual manipulation. Further, the latch mechanism is easily released by the exertion of a minimal amount of intentional upward manual force.

Materials that the present invention may be made from are not critical to the practice of the present invention. The materials may be those conventionally used in producing latch mechanisms, more particularly those materials used in the airline industry. The materials should be rigid and not susceptible to cracking. Preferably, the materials are chosen from inexpensive plastics or metal compositions.

While this invention has been described in a specific form and as operating in a specific manner for the purpose of illustration, it is to be understood that the invention is not limited thereto. Various modifications will suggest themselves to those skilled in the art without departing from the spirit of this invention, the scope of which is set forth in the following claims.

The embodiments of the invention in which an exclusive property or privilege is claimed are defined as follows:

1. A releasable latch mechanism for fastening a first surface to a second surface comprising:
   (a) a striker arm having first and second ends;
   (b) a striker means on the first end of the striker arm;
   (c) a striker support means for mounting the second end of the striker arm for movement therein, the striker support means supporting the striker arm and including means for fastening the striker support means onto the first surface to be fastened;
   (d) means for restricting the movement of the striker arm in the striker support;
   (e) hook means for fastening the striker means;
   (f) housing means for mounting the hook means therein; and
   (g) a base plate including a means for slidably mounting the housing means, means defining an opening allowing the hook means to pass through the face of the base plate, means in the face of the base plate cooperating with said hook means for receiving and retaining the striker means, and means for mounting the base plate to the second surface to be fastened.

2. The releasable latch mechanism of claim 1, wherein the first surface is the inside surface of an overhead airline storage bin.

3. The releasable latch mechanism of claim 2, wherein the second surface is the door of an overhead airline storage bin.

4. The releasable latch mechanism of claim 1, wherein the means for restricting the movement of the striker arm in the striker support means include rubber cushions mounted between the striker arm and the striker support means.

5. The releasable latch mechanism of claim 1, wherein the means for receiving and retaining the striker means includes a recess in the face of the base plate.

6. The releasable latch mechanism of claim 5, wherein the range of motion of the housing means is such that at one extreme the hook means securely fastens the striker means in the recess in the face of the base plate and at the other extreme the hook means releases the striker means from the recess in the face of the base plate.

7. The releasable latch of claim 5, wherein the hook means includes an inwardly angled leading edge and can effectively fasten the striker means in the recess without manually moving the housing means.

8. The releasable latch mechanism of claim 3, wherein the hook means engages the striker means in the recess until an intentional manual force is applied to the housing means.

9. The releasable latch mechanism of claim 3, wherein the recess in the face of the base plate prevents the hook means from disengaging the striker means until an intentional manual force is applied to the housing means.

10. The releasable latch mechanism of claim 4, wherein the striker arm has a limited range of motion sufficient to absorb deformations in the first or second surface to which the striker support means and base plate are respectively mounted without allowing the hook means to disengage the striker means.

11. A releasable latch mechanism for fastening a first surface to a second surface comprising:

(a) a striker arm having a forked end;

(b) a striker mounted between the furcations of the forked end;

(c) a striker support for rotatably mounting the striker arm therein, the striker support including means for rotatably supporting the striker arm and means for mounting the striker support onto the first surface to be fastened;

(d) bumpers mounted in the striker arm for restricting the rotatable movement of the striker arm in the striker support;

(e) a hook for fastening the striker;

(f) a hook housing for mounting the hook therein; and (g) a base plate including a means for slidably mounting the hook housing, an opening in the face of the base plate allowing the hook to project through the face of the base plate, a recess in the face of the base plate for receiving the striker and the forked end of the striker arm, the recess disposed so that the hook and recess cooperate to securely fasten the striker, and means for mounting the base plate to the second surface to be fastened.

12. The releasable latch mechanism of claim 1, wherein the means for restricting the movement of the striker arm further includes means for adjusting the position of the striker arm within the striker support.

13. The releasable latch mechanism of claim 12, wherein the means for restricting the movement of the striker arm includes a screw means passing through the striker arm.

14. A releasable latch mechanism for fastening a first member to a second member by moving said first and second members in a first direction toward each other comprising:

a striker arm having first and second ends, said striker arm having a striker affixed to the first end thereof;

means mounting the second end of the striker arm to said first member so that said first end extends generally in said first direction away from said first member and so that said first end can move between first and second positions in a direction transverse to said first directions;

a base plate and means mounting said base plate to said second member;

hook means associated with said base plate and moveable in a direction transverse to said first direction for releasably capturing said striker when said striker is moved into proximity of said base plate; and means associated with said base plate for limiting movement of said striker relative to said hook means when said hook means is capturing said striker and said second end of said striker arm is moved in a direction transverse to said first direction, thereby preventing premature release of said hook means from said striker.

* * * * *